US005343650A

United States Patent [19]

Swan

[11] Patent Number: 5,343,650

[45] Date of Patent: Sep. 6, 1994

[54] EXTENDED RIGID FRAME RECEIVER SLEEVE

[76] Inventor: Richard E. Swan, 375 West St., W. Bridgewater, Mass. 02379

[21] Appl. No.: 859,958

[22] Filed: Mar. 30, 1992

[51] Int. Cl.[5] ..... F41G 1/387; F41G 1/00

[52] U.S. Cl. ..... 42/100; 42/75.01

[58] Field of Search ..... 42/100, 75.01, 101, 42/103, 102; 89/14.1

[56] References Cited

U.S. PATENT DOCUMENTS

| | | | |
|---|---|---|---|
| 1,115,979 | 11/1914 | Sillix | 42/75.01 |
| 2,775,166 | 12/1956 | Janson | 42/101 |
| 2,844,710 | 7/1958 | Zinsser | 42/103 |
| 4,845,871 | 7/1989 | Swan | 42/101 |

FOREIGN PATENT DOCUMENTS

| | | | |
|---|---|---|---|
| 891381 | 3/1944 | France | 42/100 |
| 2592149 | 6/1987 | France | 42/100 |

*Primary Examiner*—Stephen M. Johnson
*Attorney, Agent, or Firm*—John P. McGonagle

[57] ABSTRACT

An extended rigid interface frame with upper and lower rails joined to a firearm receiver and extending forward above the firearm's barrel to a head assembly replacing the firearm's normal front sight. A weaver type interface return portion is provided below the barrel from the head assembly to the receiver. A yoke braces the extended rigid frame receiver sleeve of the present invention to the forward portion of the firearm's receiver. The distal end of the extended rigid frame receiver sleeve terminates in the front sight housing which connects the upper and lower rails and provides a housing for advanced laser and sensor components, and the standard front sight bead. The front sight housing is self supported by the connection of the upper and lower rails running back to the yoke and secured to the top of the receiver. The barrel of the rifle is free floating in that it does not touch the extended rigid frame receiver sleeve in any manner. Protective spring-loaded hand guards are incorporated into the extended rigid frame receiver sleeve, thereby protecting a user's hands from a hot barrel, eliminating any pressure on the barrel, and providing quick access to the barrel area.

24 Claims, 7 Drawing Sheets

EXTENDED RIGID FRAME RECEIVER SLEEVE

BACKGROUND OF THE INVENTION

This invention relates to integration means, and more particularly to a device, added to a firearm and extending from the firearm's upper receiver over the firearm's barrel to the firearm's normal front sight position, for incorporating firearm ancillary equipment.

As the field of combat and commercial weaponry expands, numerous add-on enhancements have become available for attachment to standard firearms thereby significantly upgrading the capability of the firearm. Various methods and means have been developed for interfacing the various add-on enhancements to firearms. The Swan/Weaver rail described in U.S. Pat. No. 4,845,871, discloses a quickly detachable interface means for modular enhancements. Applicant's copending application, Ser. No. 07/763,966, now U.S. Pat. NO. 5,142,806 filed Sep. 23, 1991, incorporated herein by reference, discloses a universal receiver sleeve having an upper interface portion with standard, universal dimensions regardless of the firearm and having a lower interface portion specific to a particular firearm.

The above types of devices have a basic limitation because of their interface only to the firearm receiver's short length. Most standard firearms have a front, barrel mounted, "iron" sight for aiming. The front sight can interfere with the various enhancements interconnected to the receiver sleeve. Most standard firearms are also hand-held with two hands. The first hand generally holds the barrel portion of the firearm while the second hand holds the stock/pistol grip for activation of the firearm trigger. The first hand can also interfere with the various aiming enhancements interconnected to the receiver sleeve, and can deflect the point of aim due to hand pressure. Hand guards connected to the barrel can cause discomfort to the first hand due to overheated barrels in rapid fire. Unwanted heavy barrels are used to help retard barrel deflection and for heat retardation.

SUMMARY OF THE INVENTION

In view of the foregoing disadvantages inherent in the known types of devices now present in the prior art, the present invention provides an improved receiver sleeving system. As such, the general purpose of the present invention, which will be described subsequently in greater detail, is to provide a new and improved interface means for firearms which will eliminate interference from the firearm's front sight or the user's hands while providing various capabilities for mounting and integrating optics, lasers and sensors.

To attain this, the present invention extends the universal receiver sleeve forward above the firearm barrel to a position formerly occupied by the firearm front sight, or tailored to the purpose. The barrel mounted front iron sight is eliminated and interface means are provided above and forward of the user's hands. A weaver type interface return portion is provided below the barrel to the receiver. A yoke braces the extended rigid frame receiver sleeve of the present invention to the forward portion of the firearm's receiver. The distal end of the extended rigid frame receiver sleeve terminates in a front site housing which connects the upper and lower rails and acts as the front sight housing for advanced laser and sensor components, and a standard front sight bead. The front sight housing is self supported by the connection of the upper and lower rails running back to the yoke and secured to the top of the receiver. The barrel of the rifle is free floating in that it does not touch the extended rigid frame receiver sleeve in any manner. This permits greater shooting accuracy and protects sensitive electrical components within the front sight housing by isolating the front sight housing from the heat generated from the barrel. Protective spring-loaded hand guards are incorporated into the extended rigid frame receiver sleeve, thereby protecting a user's hands from a hot barrel, eliminating any pressure on the barrel, and providing quick access to the barrel area. The upper rear of the top rail is also modular in that it allows for height adjustment for selected optics that may require various eye relief and/or interface adjustments, but will not require an exchange of the sleeve frame from the upper receiver. Lighter weight barrels can be utilized as they are no longer deflected by outside pressure and direct transfer of heat to the hand is eliminated.

The present invention provides a foundation for integrated laser fire control devices, sensors, communications, and a vast array of quickly attached ancillary devices, such as standard night vision, thermal, shot guns, grenade launchers, and special systems.

The required extra heavy barrels on conventional rifles and carbines are not required with the present invention. A standard light weight barrel can be utilized because rigid frame receiver sleeve isolates and prevents hand, sling, and bipod pressure from deflecting the barrel. With the present invention barrel handguards are not attached to the hot barrels and provide a much cooler grip to the shooter. Weight reductions of at least one-half pound can be accomplished by use of a light weight barrel and the elimination of the iron front sight frame and conventional hand guard barrel hardware.

The rigid frame receiver sleeve is attached to the firearm upper receiver in a manner that provides a solid system, non-removable except by a qualified armorer. Greater accuracy is accomplished because, like advanced sniper systems, the firearm has a free floating barrel with the instant invention and thereby no outside forces deflecting point of aim.

Multiple height adjustments to accommodate various optic selections is accomplished with the present invention's multi-level rear sleeve portion. A second rear sight is provided in front of the removable slide as a back up if the optic is removed.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 1:
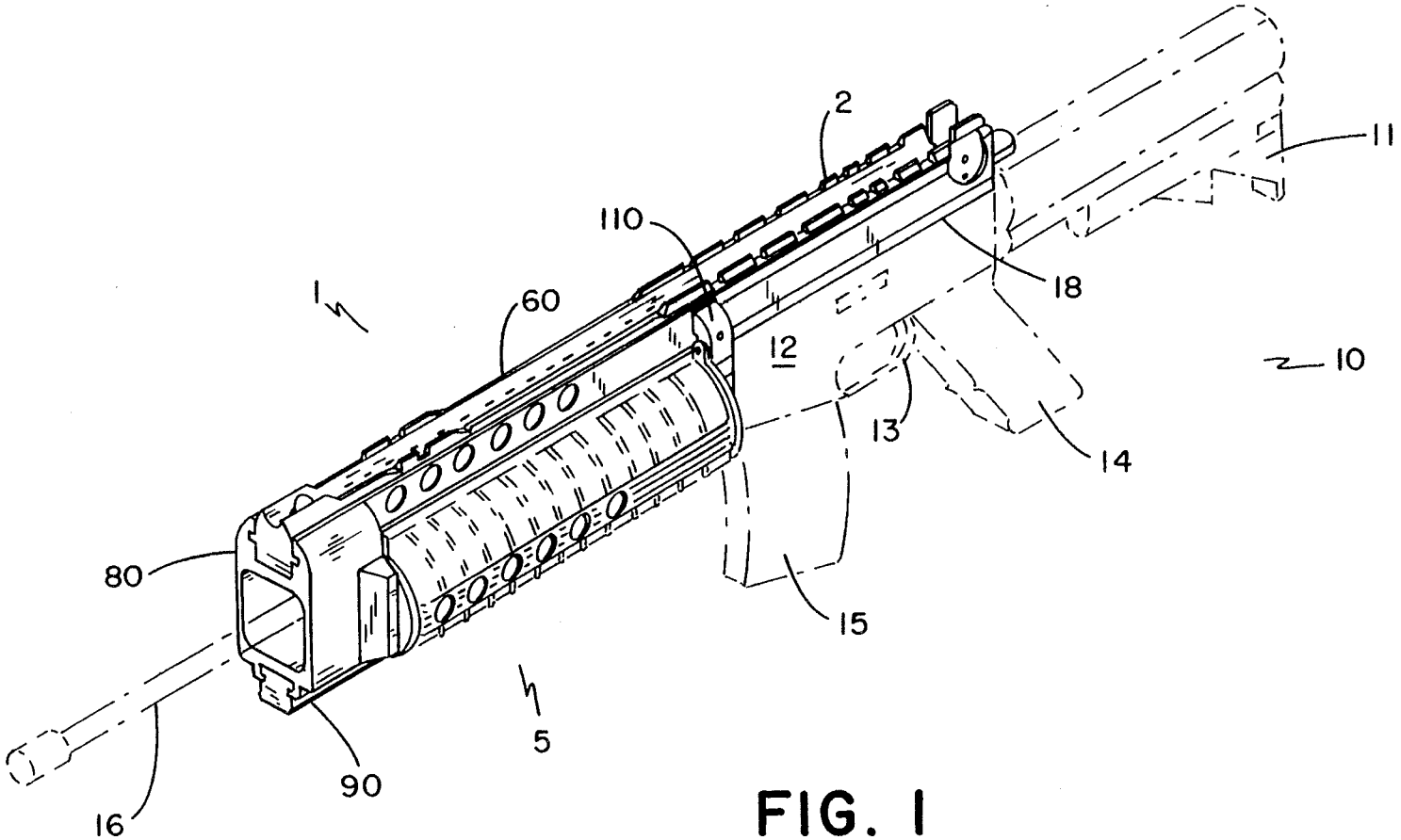
FIG. 1 is a perspective view of an extended rigid frame receiver sleeve according to the present invention.
Figure 2:
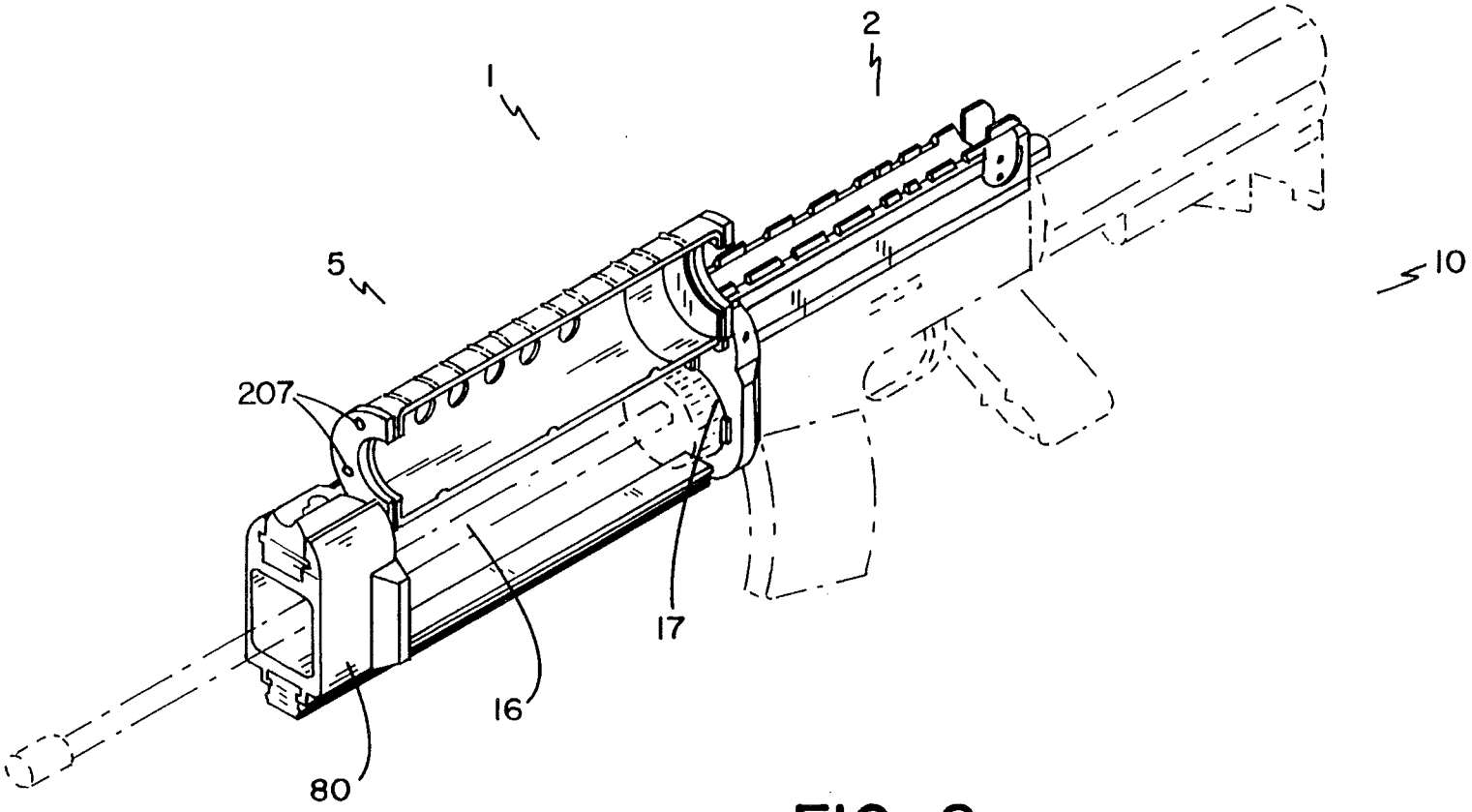
FIG. 2 is the view of FIG. 1 with one of the invention's hand guards in an open position.
Figure 3:
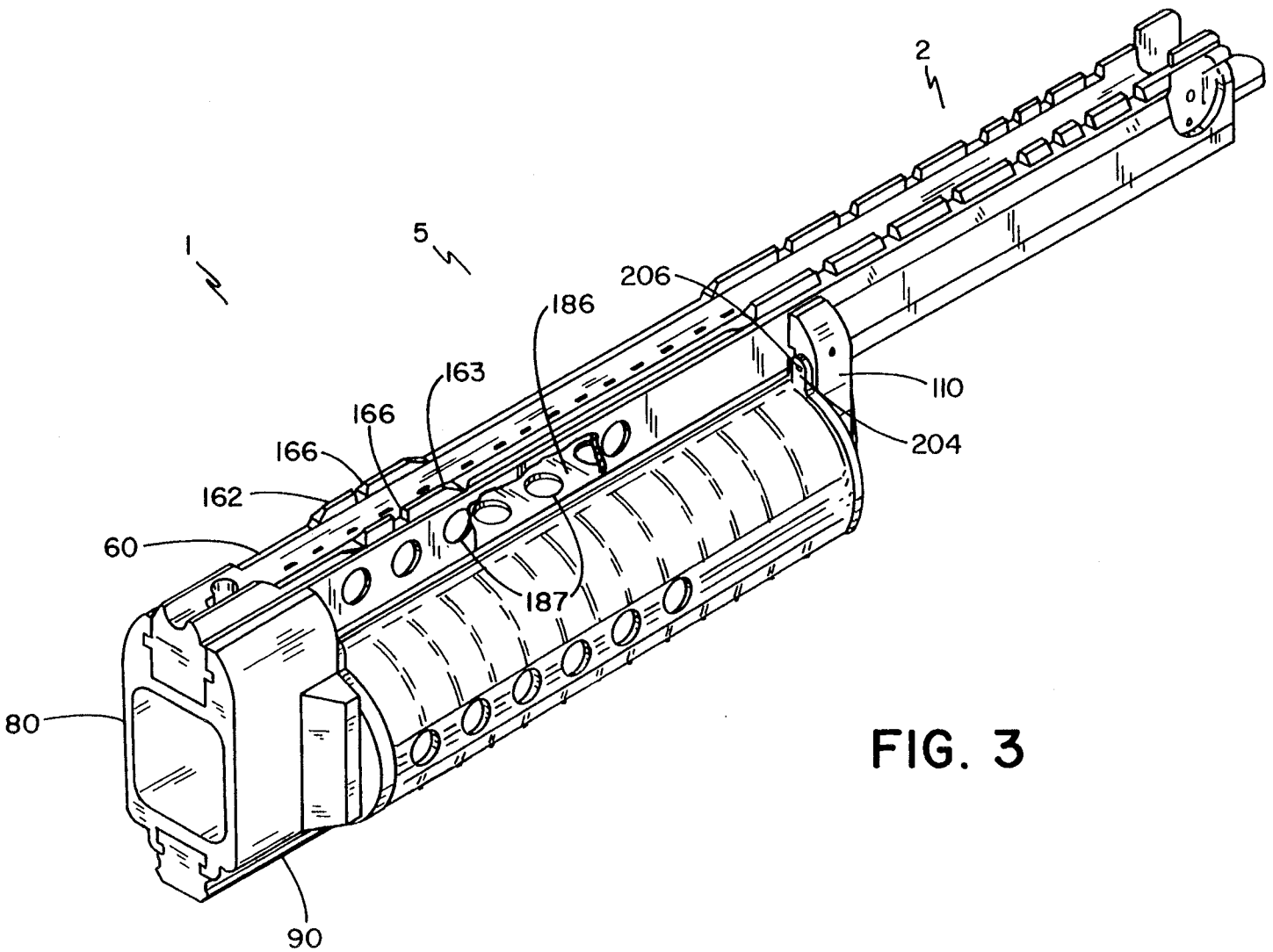
FIG. 3 is a close up of the view of FIG. 1 with a portion of the upper rail cut away.
Figure 4:
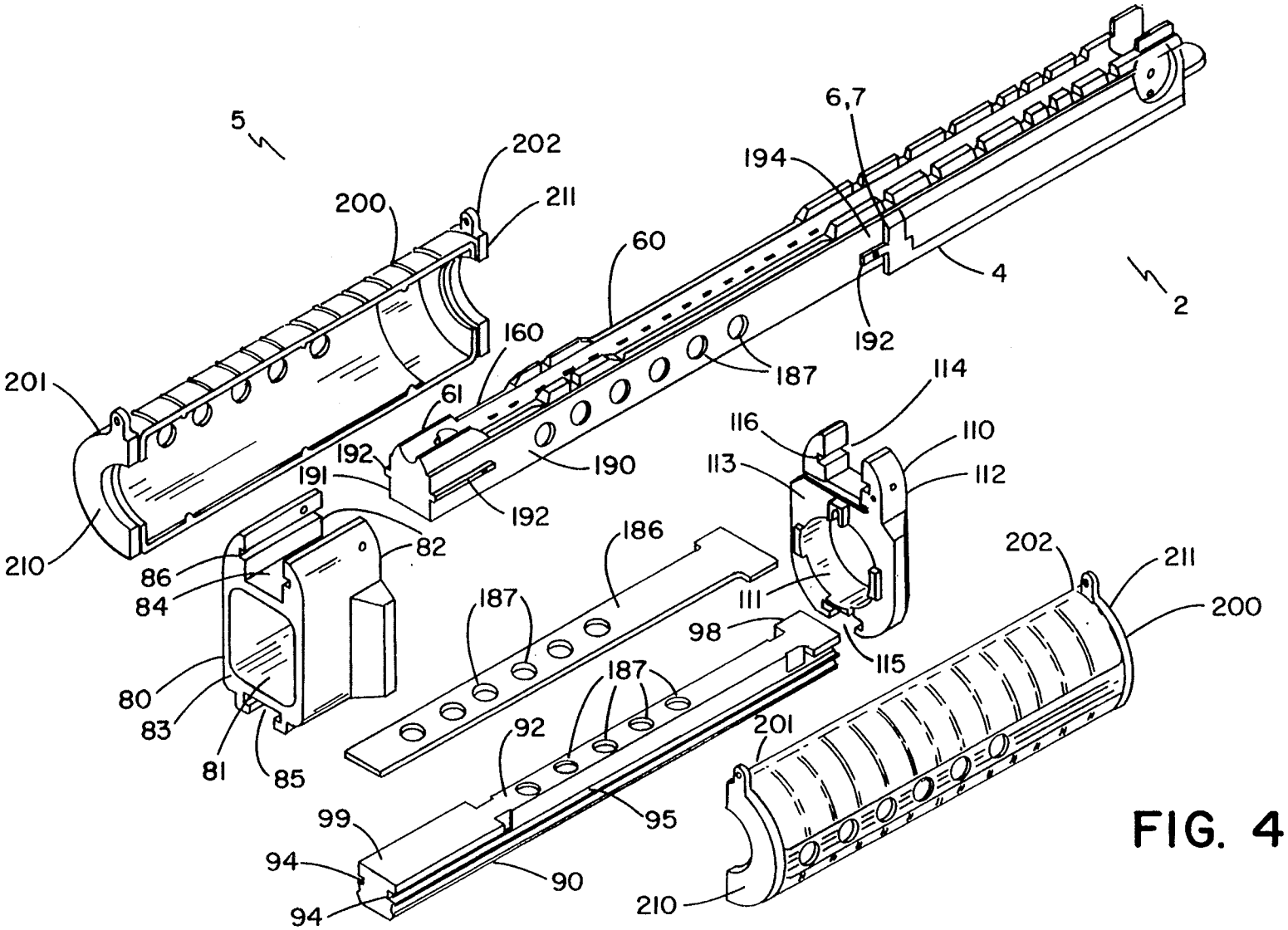
FIG. 4 is an exploded view of the sleeve of FIG. 1.
Figure 5:
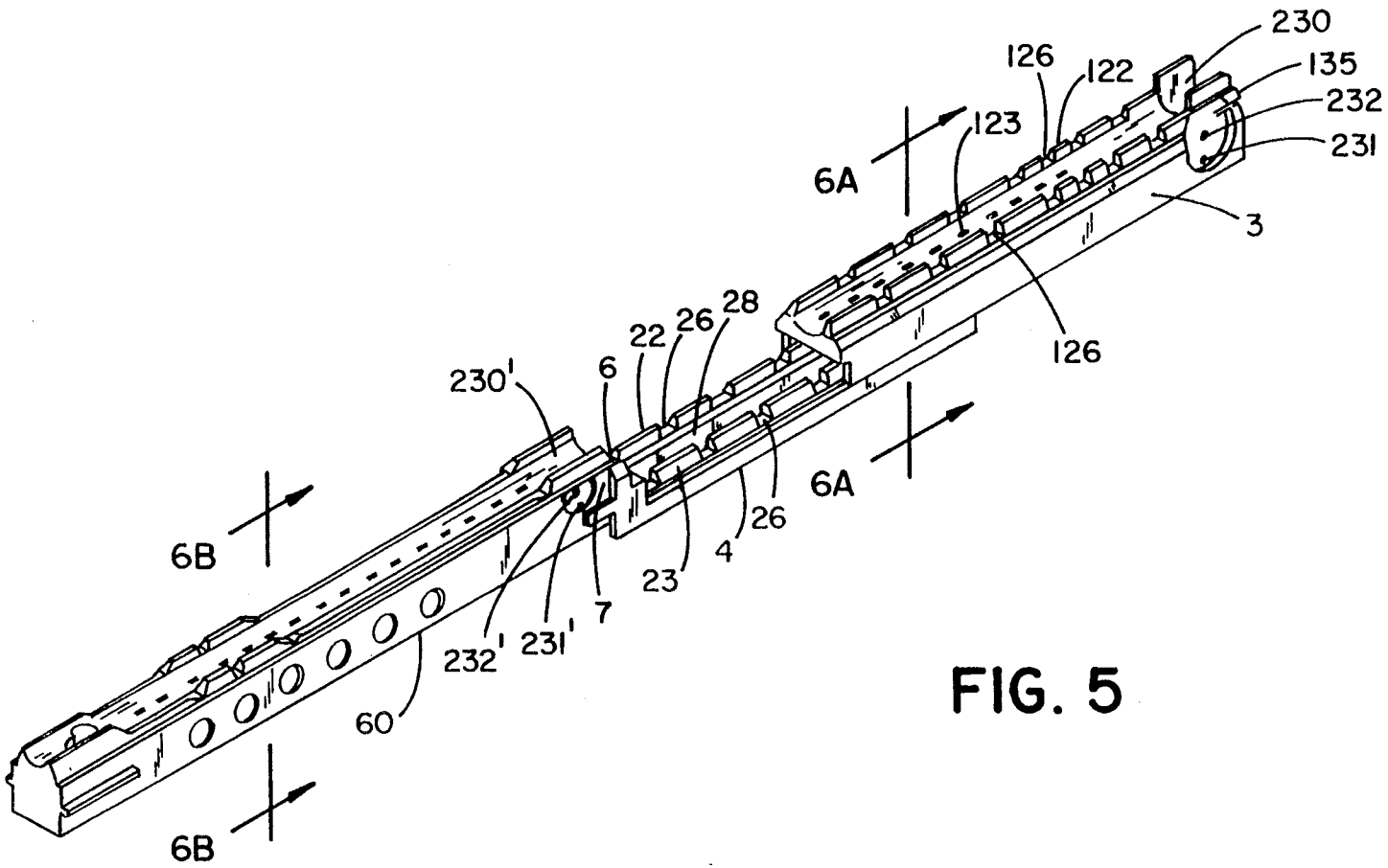
FIG. 5 is a view of the sleeve railing of FIG. 4 with the slidable sleeve element partially removed from the receiver interface sleeve element, and a second forward positioned rear flip up sight.
Figure 6A:
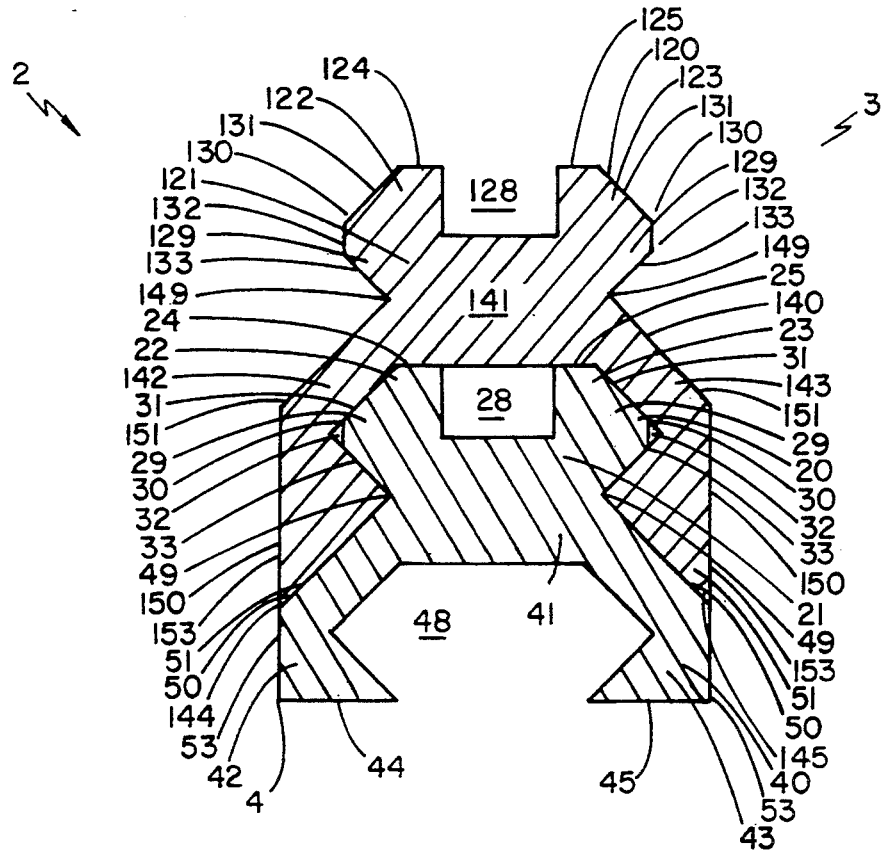
FIG. 6A is a cross sectional view along the line 6A—6A of FIG. 5.
Figure 6B:
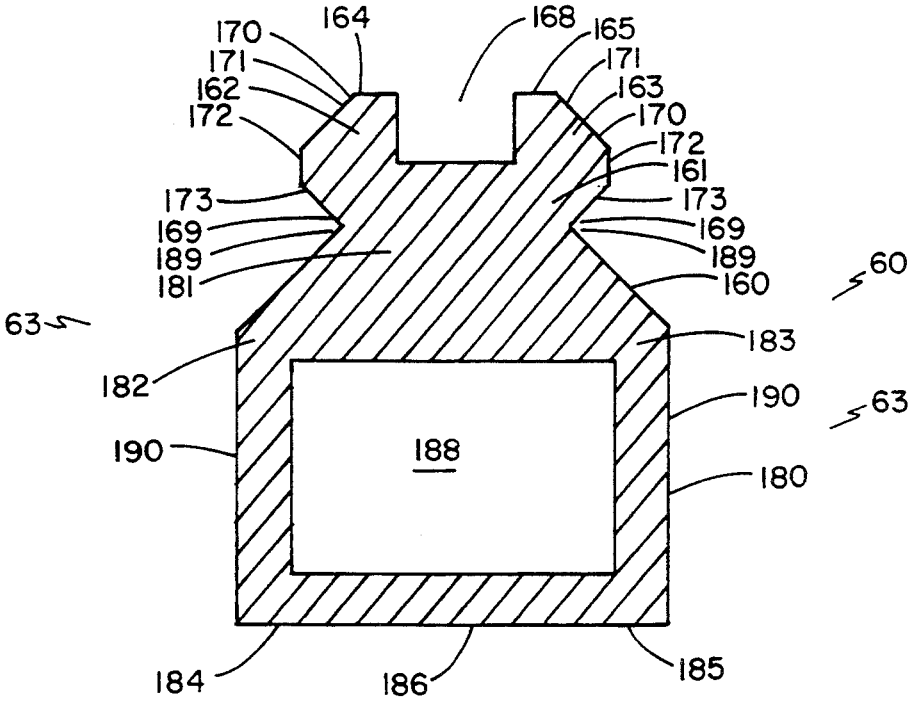
FIG. 6B is a cross sectional view along the line 6B—6B of FIG. 5.
Figure 7:
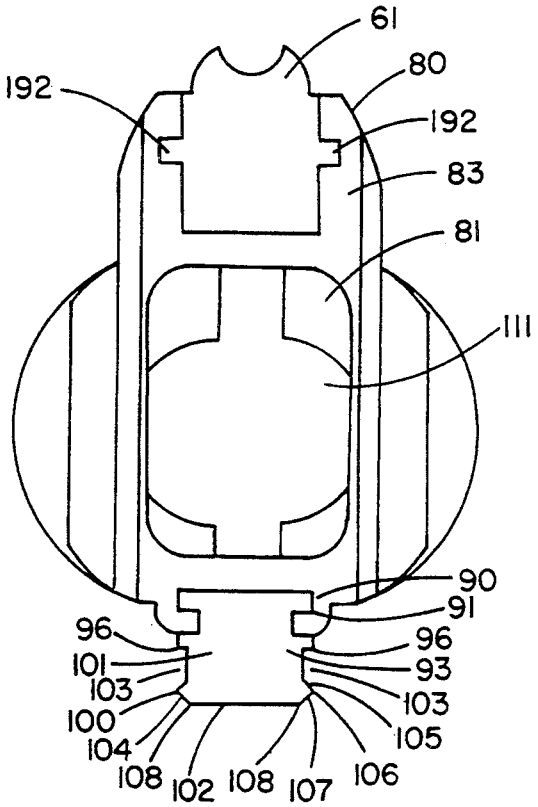
FIG. 7 is a front elevational view of the sleeve of FIG. 3.

Referring to the drawings in detail wherein like elements are indicated by like numerals, there is shown in FIGS. 1 and 2 an extended rigid frame receiver sleeve 1 mounted on a conventional combat firearm 10, said firearm 10 having a conventional stock upper receiver 12, lower receiver 13, pistol grip 14, magazine 15, and barrel 16. The barrel 16 defines the forward portion of the firearm 10 and the stock 11 defines the rearward portion of the firearm 10. The longitudinal axis of the firearm 10 runs from stock 11 through receiver 12, 13 to barrel 16. The barrel 16 is joined to the forward portion 17 of the upper receiver 12, i.e., the upper receiver 12 "receives" the barrel 16. The extended rigid frame receiver sleeve 1 has a forward interface portion 5 and a rearward interface portion 2 having a receiver interface sleeve element 4 and slidable sleeve element 3.

Referring also to FIGS. 3, 4, 5, 6A and 6B the rearward portion 2 of the extended rigid frame receiver sleeve 1 is comprised of a slidable sleeve element 3 slidably joined to a fixed receiver interface sleeve element 4. Both elements 3 and 4 are similar to the universal receiver sleeve of Applicant's copending application, Ser. No. 07/763,966, filed Sep. 23, 1991, and incorporated herein by reference. The interface element 4 is joined to the top 18 of the upper receiver 12. The interface element 4 has a top section 20 and a bottom section 40 and a longitudinal axis extending in spaced, parallel relation to the longitudinal axis of the firearm 10. The interface element top section 20 has a longitudinal, horizontally positioned base portion 21 along its length. The base portion 21 has two long side edges 29. A first longitudinal rail 22 extends upward from the base portion 21 adjacent one of the long side edges 29 and a second longitudinal rail 23 extends upward from the base portion 21 adjacent the other of the long side edges 29. The second rail 23 is in spaced parallel relationship to the first rail 22. A longitudinal opening, i.e., channel 28, is formed between the first and second rails 22, 23. The upper surface 24 of the first rail 22 lies on the same horizontal plane as the upper surface 25 of the second rail 23.

Optional notches 26 may also be provided in the rails 22, 23. The notches 26 provide additional means of engaging other components. The quantity and placement of pairs of notches 26 are as required or needed. In this embodiment of the invention, a series of facing, rectangular notches 26 are formed transversely through the first and second rails 22, 23.

Each of the two long side edges 29 of the base portion 21 and rails 22, 23 are integral with external angled engagement surfaces 30 which extend the full length of the top section 20. The surfaces 30 each have a middle longitudinal section 32, upper longitudinal section 31, and lower longitudinal section 33. The upper section 31 surface planes are directed outwardly and downwardly at a forty-five degree angle from the horizontal planes of the rail upper surfaces 24, 25. The middle section 32 surface planes are directed vertically downwardly from the upper section 31 surface planes in planes perpendicular to the horizontal planes of the rail upper surface 24, 25 planes. The lower section 33 surface planes are directed inwardly and downwardly at a forty-five degree angle from the vertical planes of the middle sections 32 to the bottom section base side edges 49.

The interface element top section 20 is joined to the interface element bottom section 40. The interface element bottom section also has a longitudinal, horizontally positioned base portion 41 along its length. The base portion 41 has two long side edges 49. A first rail 42 extends downward from the base portion 41 adjacent one of the long side edges 49 and a second rail 43 extends downward from the base portion 41 adjacent the other of the long side edges 49. The second rail 43 is in spaced parallel relationship to the first rail 42. The top section base 21 is joined in a mirrored, face to face relationship to the bottom section base 41. The joining faces of both bases 21, 41 have the same dimensions.

The lower surface 44 of the first rail 42 lies on the same horizontal plane as the lower surface 45 of the second rail 43. Each of the two long side edges 49 of the base portion 41 and the rails 42, 43 are integral with an angled engagement surface 50 which extends the full length of the bottom section 40. The surface 50 has an upper longitudinal section 51 and a lower longitudinal section 53. The upper section 51 surface planes are directed outwardly and downwardly at a forty-five degree angle from the horizontal plane of the bottom section base 41. The lower section 53 planes are directed vertically downward from the upper section 51 surface planes to the lower surfaces 44, 45 of the first 42 and second 43 rails, respectively. A longitudinal resultant opening, i.e., channel 48, is formed between the integrated rail-angled engagement surfaces 42, 50 and 43, 50.

The front 6 of the interface element 4 joins the rear 7 of the forward portion 5 of the sleeve 1. The slidable sleeve element 3 is slidably joined to the fixed receiver interface sleeve element 4. The slidable sleeve element 3 has a top section 120 and a bottom section 140 and a longitudinal axis extending in spaced, parallel relation to the longitudinal axis of the firearm receiver interface sleeve element 4. The slidable sleeve element top section 120 has a longitudinal, horizontally positioned base portion 121 along its length. The base portion 121 has two long side edges 129. A first longitudinal rail 122 extends upward from the base portion 121 adjacent one of the long side edges 129 and a second longitudinal rail 123 extends upward from the base portion 121 adjacent the other of the long side edges 129. The second rail 123 is in spaced parallel relationship to the first rail 122. A longitudinal opening, i.e., channel 128, is formed between the first and second rails 122, 123. The upper surface 124 of the first rail 122 lies on the same horizontal plane as the upper surface 125 of the second rail 123.

Optional notches 126 may also be provided in the rails 122, 123. The notches 126 provide additional means of engaging other components. The quantity and placement of pairs of notches 126 are as required or needed. In this embodiment of the invention, a series of facing, rectangular notches 126 are formed transversely through the first and second rails 122, 123.

Each of the two long side edges 129 of the base portion 121 and rails 122, 123 are integral with external angled engagement surfaces 130 which extend the full length of the top section 120. The surfaces 130 each have a middle longitudinal section 132, upper longitudinal section 131, and lower longitudinal section 133. The upper section 131 surface planes are directed outwardly and downwardly at a forty-five degree angle from the horizontal planes of the rail upper surfaces 124, 125. The middle section 132 surface planes are directed vertically downwardly from the upper section 131 surface planes in planes perpendicular to the horizontal planes of the rail upper surface 124, 125 planes. The lower section 133 surface planes are directed inwardly and downwardly at a forty-five degree angle from the vertical planes of the middle sections 132 to the bottom section base side edges 149.

The slidable sleeve element top section 120 is joined to the slidable sleeve bottom section 140. The sleeve bottom section 140 also has a longitudinal, horizontally positioned base portion 141 along its length. The base portion 141 has two long side edges 149. A first rail 142 extends downward from the base portion 141 adjacent one of the long side edges 149 and a second rail 143 extends downward from the base portion 141 adjacent the other of the long side edges 149. The second rail 143 is in spaced parallel relationship to the first rail 142. The top section base 121 is joined in a mirrored, face to face relationship to the bottom section base 141. The joining faces of both bases 121, 141 have the same dimensions.

The lower edge 144 of the first rail 142 lies on the same horizontal plane as the lower edge 145 of the second rail 143. Each of the two long side edges 149 of the base portion 141 and the rails 142, 143 are integral with an angled engagement surface 150 which extends the full length of the bottom section 140. The surface 150 has an upper longitudinal section 151 and a lower longitudinal section 153. The upper section 151 surface planes are directed outwardly and downwardly at a forty-five degree angle from the horizontal plane of the bottom section base 141. The lower section 153 planes are directed vertically downward from the upper section 151 surface planes to the lower surfaces 144, 145 of the first 142 and second 143 rails, respectively. A longitudinal resultant opening 148 is formed between the integrated rail-angled engagement surfaces 142, 150 and 143, 150.

The slidable sleeve element 3 incorporates a standard non-optical sight 230 at the rear 135 of the top section 120. Windage and elevational adjustments 231 and 232 may also be included. An optional, additional standard non-optical sight 230' is incorporated at the rear 7 of the upper forward sleeve element 60. Windage and elevational adjustments 231' and 232' may also be included. The sight plane for the non-optical sights is formed by the channels 128 and 168.

The forward portion 5 of the sleeve 1 extends from the rearward sleeve portion 2 joined to the upper receiver 12 to a position normally occupied by a front sight mounted on the weapon's barrel 16. The conventional front sight is replaced with a head assembly 80 sometimes referred to as the front sight housing or smart front sight. The upper sleeve element extending from the rearward portion sleeve element 2 to the head assembly 80 will be referred to with the reference numeral 60. A yoke 110 engages the forward portion 17 of the upper receiver 12 above and below the barrel receptacle 19, and the junction 6, 7 between the upper forward sleeve element 60 and the rearward portion receiver interface sleeve element 4 for added support. A weaver type interface return element 90 extends backward from the head assembly 80 below the barrel 16 to the yoke 110. Neither the head assembly 80 nor any part of the sleeve forward portion 5 touches the barrel 16. The fixed attachment of the yoke 110 to the forward portion 17 of the receiver 12 and the sleeve rearward portion receiver interface sleeve element 4 attachment to the top 18 of the receiver 12 provide the support for the entire extended rigid frame receiver sleeve 1.

The forward portion upper sleeve element 60 has a top section 160 and a bottom section 180 and a longitudinal axis extending in spaced, parallel relation to the longitudinal axis of the firearm 10. The upper sleeve element top section 160 has a longitudinal, horizontally positioned base portion 161 along its length. The base portion 161 has two long side edges 169. A first longitudinal rail 162 extends upward from the base portion 161 adjacent one of the long side edges 169 and a second longitudinal rail 163 extends upward from the base portion 161 adjacent the other of the long side edges 169. The second rail 163 is in spaced parallel relationship to the first rail 162. A longitudinal opening, i.e., channel 168, is formed between the first and second rails 162, 163. The upper surface 164 of the first rail 162 lies on the same horizontal plane as the upper surface 165 of the second rail 163.

Optional notches 166 may also be provided in the rails 162, 163. The notches 166 provide additional means of engaging other components. The quantity and placement of pairs of notches 166 are as required or needed. In this embodiment of the invention, two facing, rectangular notches 166 are formed transversely through the first and second rails 162, 163.

Each of the two long side edges 169 of the base portion 161 and rails 162, 163 are integral with external angled engagement surfaces 170 which extend the full length of the top section 160. The surfaces 170 each have a middle longitudinal section 172, upper longitudinal section 171, and lower longitudinal section 173. The upper section 171 surface planes are directed outwardly and downwardly at a forty-five degree angle from the horizontal planes of the rail upper surfaces 164, 165. The middle section 172 surface planes are directed vertically downwardly from the upper section 171 surface planes in planes perpendicular to the horizontal planes of the rail upper surface 164, 165 planes. The lower section 173 surface planes are directed inwardly and downwardly at a forty-five degree angle from the vertical planes of the middle sections 172 to the bottom section base side edges 189.

The forward portion upper sleeve element top section 160 is joined to the upper sleeve element bottom section 180. The upper sleeve element bottom section 180 also has a longitudinal, horizontally positioned base portion 181 along its length. The base portion 181 has two long side edges 189. A first rail 182 extends downward from the base portion 181 adjacent one of the long side edges 189 and a second rail 183 extends downward from the base portion 181 adjacent the other of the long side edges 189. The second rail 183 is in spaced parallel relationship to the first rail 182. The top section base 161 is joined in a mirrored, face to face relationship to the bottom section base 181. The joining faces of both bases 161, 181 have the same dimensions.

The lower surface 184 of the first rail 182 lies on the same horizontal plane as the lower surface 185 of the second rail 183 and are interconnected by means of a longitudinal element 186 thereby forming an enclosed cavity 188 with a generally rectangular cross section. The rails 182, 183 and longitudinal element 186 each have a series of apertures 187 formed therein. The purpose of the apertures 187 is to provide a means for ventilating heat generated from the barrel 16 while the firearm 10 is being used. See FIG. 3. Each of the two long side edges 189 of the base portion 181 and the rails 182, 183 are integral with a vertical engagement surface 190 which extends the full length of the bottom section 180. The rail apertures 187 extend through the surface 190.

The head assembly 80 has a generally rectangular shape with a rear face 82, front face 83, generally rectangular central opening 81, upper interface channel 84 and lower interface channel 85. The longitudinal axis of the head assembly 80 is vertically positioned transverse to the horizontal longitudinal axis of the firearm 10. The upper interface channel 84 has a cross section corresponding to the external cross section of the forward portion upper sleeve element bottom section 180. The forward portion 191 of the bottom section engagement surface 190 has a horizontal elongated protrusion 192 formed on each side. Corresponding grooves 86 are formed in the head assembly upper interface channel 84. The forward end 61 of the forward portion upper sleeve element 60 terminates in the head assembly upper interface channel 84.

The weaver type interface return element 90 has a top section 91 and a bottom section 100. The top section 91 has a generally rectangular shaped cross section, a flat top 92, flat base 93, and a longitudinal channel 94 along the length of each side 95 of the weaver type interface return element 90. Each side 95 of the base 93 has an angled engagement surface 96 extending the full length of the top section 91 and extending inwardly and downwardly from the top section base 93.

The bottom section 100 has a top portion 101, and two long side edges 103 and a flat bottom 102. Each of the two long side edges 103 of the base portion 101 have external angled engagement surfaces 104 which can extend the full length of the bottom section 100 or can be cut away for hand comfort and/or other attachments, such as bipods, tripods, forward pistol grips, grenade launchers, and the like. The surfaces 104 each have a middle longitudinal section 106, upper longitudinal section 105, and lower longitudinal section 107. The upper section 105 surface planes are directed outwardly and downwardly at a forty-five degree angle from the top section angled engagement surfaces 96. The middle section 106 surface planes are directed vertically downwardly from the upper section 105 surface planes in planes perpendicular to the horizontal plane of the flat bottom 102 planes. The lower section 107 surface planes are directed inwardly and downwardly at a forty-five degree angle from the vertical planes of the middle sections 106 to the bottom section base side edges 108. The bottom section may be altered to accommodate various attachments. A series of vertical apertures 187 are formed through the return element 90 along its longitudinal axis. This provides additional ventilation for the barrel 16 when in use.

The head assembly lower interface channel 85 has a T-shaped cross section corresponding to the T-shaped external cross section of the weaver type interface return element top section 91. The forward portion 99 of the weaver type interface return element top section 91 engages the head assembly lower interface channel 85. The T-shaped cross section can be configured to other dimensions and shapes, and for dimensional limitations and preferred connections.

As stated above the yoke 110 engages the forward portion 17 of the upper receiver 12 and the junction 6, 7 between the upper forward sleeve element 60 and the rearward portion receiver interface sleeve element 4. The weaver type interface return element 90 extends backward from the head assembly 80 below the barrel 16 to the yoke 110. The yoke 110 has a generally rectangular shape with a rear face 112, forward face 113, sides 117, generally rectangular central opening 111, upper interface channel 114 and lower interface channel 115. The longitudinal axis of the yoke assembly 110 is vertically positioned transverse to the horizontal longitudinal axis of the firearm 10. The upper interface channel 114 has a cross section corresponding to the external cross section of the forward portion upper sleeve element bottom section 180. The rearward portion 194 of the bottom section engagement surface 190 has a horizontal elongated protrusion 192 formed on each side. Corresponding grooves 116 are formed in the head assembly upper interface channel 114. The junction 6, 7 between the upper forward sleeve element 60 and the rearward portion receiver interface sleeve element 4 is positioned within yoke upper interface channel 114. The yoke assembly lower interface channel 115 has a T-shaped cross section corresponding to the T-shaped external cross section of the weaver type interface return element top section 91. The rearward portion 98 of the weaver type interface return element top section 91 terminates in the yoke assembly lower interface channel 115.

Conventional hand guards 200 are mounted onto the forward portion 5 of the sleeve 1. The hand guards 200 are attached to the yoke 110 and head assembly 80 so that the guards 200 will rotate radially upward away from the weaver type interface return element 90, thereby providing access to the barrel 16 for replacement without requiring removal of the sleeve 1. Each hand guard forward 201 and rear end 202 terminates in a clip 204 or hinge 210, 211. Each forward hinge 210 is rotatably pinned to the rear face 82 of the head assembly 80. Each rear hinge 211 is rotatably pinned to the forward face 113 of the yoke 110. Each handguard 200 is held in a closed position via standard spring loaded snap buttons 207 or can be secured by customer required means such as screws 206. Each handguard 200 has a series of horizontal apertures 187 along its length as an added means for ventilation and air flow across the barrel 16.

Figure 8:
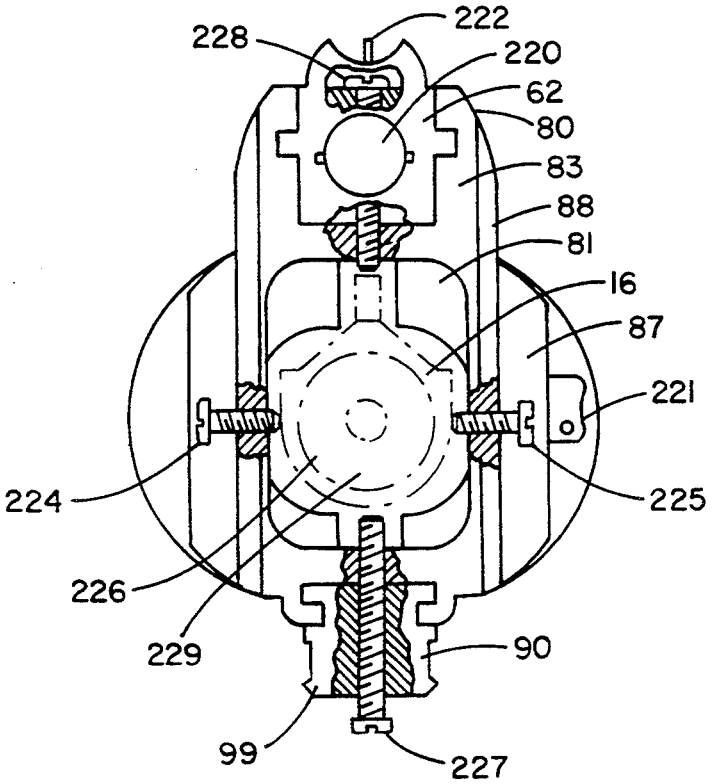
FIG. 8 is a front elevational view of another embodiment of the extended rigid frame receiver sleeve of FIG. 3.

In another embodiment of the invention illustrated in FIG. 8, an electrical output cavity 220 is formed in the front face 62 of the upper forward sleeve element 60. Since the barrel 16 "floats" centrally in the head assembly central opening 81, heat from the barrel 16 will not affect sensitive components in the cavity 220. Power for the cavity 220 in this embodiment is provided by batteries (not shown) inserted into a battery compartment 87 located on one side 88 of the head assembly 80. Modular attachment of visible and/or infrared (IR) illuminators, and visible and IR aimers may also be plugged into the cavity 220. An activation switch 221 is also mounted in the head assembly side 88 or optionally along the length of the upper forward sleeve element sides 63, thereby providing several means for activating selected electrical components. A front sight 222 is mounted on the forward end 61 of the forward portion upper sleeve element top section 160.

For firearms requiring a very high degree of aiming accuracy, one, two, three or four zeroing screws are added to the head assembly 80. In this embodiment of the invention four screws are used, two 224, 225 providing horizontal adjustment and two 227, 228 providing vertical adjustment. The horizontal screws 224, 225 penetrate the sides 88 of the head assembly 80 and radially touch a barrel locking collar 226 positioned about the forward portion of the barrel 16. Tightening or loosening of the screws 224, 225 will adjust the barrel muzzle 229 horizontally leftward or rightward. The bottom vertical screw 227 penetrates the forward portion 99 of the weaver interface 90, through the head assembly lower interface channel 85 and against the barrel locking collar 226. The top vertical screw 228 penetrates the forward portion 5 of the sleeve 1 attached to the head assembly upper interface channel 84, through the head assembly upper interface channel 84 and against the barrel locking collar 226. Tightening or loosening of the screws 227, 228 will adjust the barrel muzzle 229 vertically upward or downward. See FIG. 9. The adjustment interplay of all four screws 224, 225, 227, 228 permits adjustment of the barrel muzzle 229 in any direction for locked in alignment to the receiver 12. Zeroing of the barrel can also be accomplished via the utilization of conventional type rear sight windage and elevational controls in lieu of the adjustment screws 224, 225, 227, 228.

It is understood that the above-described embodiments are merely illustrative of the application. The sleeve's rearward 2 and forward portions 5 provide a platform with the height necessary for optics add-ons. The head assembly 80 provides a housing for various passive and active energy systems. The "floating" barrel arrangement of the instant invention ensures that heat will not be transferred from the barrel to sensitive optics, electronics and other sensitive elements contained in the head assembly. The weaver type interface return element 90 provides additional means for interfacing modules to the firearms, e.g., grenade launchers, shotgun modules, etc. The term "weaver type" is meant to be a generic description rather than a specification of a particularly shaped interface means. Other types of interface means may be used in lieu of the weaver type interface means. The entire extended rigid frame receiver sleeve may be cast as a one piece component for significant cost savings in machine time and to eliminate assembly fitting of joints and pins.

Other embodiments of the invention may be readily devised by those skilled in the art which will embody the principles of the invention and fall within the spirit and scope thereof and for which the rigid frame systems provide a unique foundation means.

I claim:

1. An extended rigid frame receiver sleeve for interfacing integrated and modular enhancements to a firearm having forward and rearward portions, said firearm having minimally a receiver with a stock and barrel attached thereto, said barrel defining the forward portion of the firearm and said stock defining the rearward portion of the firearm, said firearm longitudinal axis being defined as horizontal and running from said stock through said receiver to said barrel, said receiver being comprised of an upper receiver and a lower receiver, said upper receiver having a forward portion, a top and a rearward portion, said barrel being joined to the forward portion of the upper receiver, comprising:

a forward interface portion having sides, a front and a rear; and a rearward interface portion having sides comprised of:

a fixed receiver interface sleeve element joined to the top of the upper receiver and having a front joined to the rear of said forward interface portion; and a slidable sleeve element slidably mounted on said fixed receiver interface sleeve element.

2. An extended rigid frame receiver sleeve as recited in claim 1, wherein said fixed receiver interface sleeve element is comprised of:

a bottom section attached to said firearm receiver and having a longitudinal axis extending in spaced, parallel relation to the longitudinal axis of said firearm, said bottom section having a longitudinal, horizontally positioned base portion along its length, said base portion having two long side edges and a first longitudinal rail extending downward from said base portion adjacent one of the long side edges and a second longitudinal rail extending downward from said base portion adjacent the other of the long side edges, wherein said second rail is in spaced parallel relationship to said first rail and a longitudinal channel is formed between said first and second rails, said channel being fitted over a portion of the firearm receiver; and a top section attached to said bottom section and having a longitudinal axis extending in spaced, parallel relation to the longitudinal axis of said firearm, said top interface section having a longitudinal, horizontally positioned base portion along its length, said base portion having two long side edges, and a first longitudinal rail extending upward from said base portion adjacent one of the long side edges and a second longitudinal rail extending upward from said base portion adjacent the other of the long side edges, wherein said second rail is in spaced parallel relationship to said first rail and a longitudinal channel is formed between said first and second rails.

3. An extended rigid frame receiver sleeve as recited in claim 2, wherein said slidable sleeve element is comprised of:

a bottom section slidably joined to said fixed receiver interface sleeve element and having a longitudinal axis extending in spaced, parallel relation to the longitudinal axis of said firearm, said bottom section having a longitudinal, horizontally positioned base portion along its length, said base portion having two long side edges and a first longitudinal rail extending downward from said base portion adjacent one of the long side edges and a second longitudinal rail extending downward from said base portion adjacent the other of the long side edges, wherein said second rail is in spaced parallel relationship to said first rail and a longitudinal channel is formed between said first and second rails, said channel being fitted over a portion of the fixed receiver interface sleeve element; and a top section joined to said bottom section and having a longitudinal axis extending in spaced, parallel relation to the longitudinal axis of said firearm, said top interface section having a longitudinal, horizontally positioned base portion along its length, said base portion having two long side edges, and a first longitudinal rail extending upward from said base portion adjacent one of the long side edges and a second longitudinal rail extending upward from said base portion adjacent the other of the long side edges, wherein said second rail is in spaced parallel relationship to said first rail and a longitudinal channel is formed between said first and second rails.

4. An extended rigid frame receiver sleeve as recited in claim 3, wherein said forward interface portion is comprised of:

a head assembly having two sides, a top and a bottom;

a forward upper sleeve element extending from the rearward interface portion above the barrel to the head assembly and forming a junction with the front of the fixed receiver interface sleeve element;

a yoke engaging the front of the receiver and said junction; and a weaver type interface return element extending from the head assembly below the barrel to the yoke.

5. An extended rigid frame receiver sleeve as recited in claim 4, wherein:

neither the head assembly nor any part of forward interface portion touches the barrel.

6. An extended rigid frame receiver sleeve as recited in claim 5, wherein:

attachment of the yoke to the forward portion of the receiver and attachment of the sleeve rearward portion receiver interface sleeve element to the top of the upper receiver provide the support for the entire extended rigid frame receiver sleeve.

7. An extended rigid frame receiver sleeve as recited in claim 6, wherein said forward upper sleeve element is comprised of:

a top section having a longitudinal axis extending in spaced, parallel relation to the longitudinal axis of said firearm, said top section having a longitudinal, horizontally positioned base portion along its length, said base portion having two long side edges, and a first longitudinal rail extending upward from said base portion adjacent one of the long side edges and a second longitudinal rail extending upward from said base portion adjacent the other of the long side edges, wherein said second rail is in spaced parallel relationship to said first rail and a longitudinal channel is formed between said first and second rails; and a bottom section joined to said top section and having a longitudinal axis extending in spaced, parallel relation to the longitudinal axis of said firearm, said bottom section having a longitudinal, horizontally positioned base portion along its length, said base portion having two long side edges and a first longitudinal rail extending downward from said base portion adjacent one of the long side edges and a second longitudinal rail extending downward from said base portion adjacent the other of the long side edges, wherein said second rail is in spaced parallel relationship to said first rail and a longitudinal channel is formed between said first and second rails, said rails having lower surfaces interconnected by means of a longitudinal element thereby forming an enclosed cavity.

8. An extended rigid frame receiver sleeve as recited in claim 7, wherein:

said forward upper sleeve element bottom section rails and longitudinal element each have a series of apertures formed therein.

9. An extended rigid frame receiver sleeve as recited in claim 8, wherein:

said head assembly has a generally rectangular shape with a rear face, front face, generally rectangular central opening, upper interface channel, lower interface channel, and a longitudinal axis vertically positioned transverse to the horizontal longitudinal axis of the firearm.

10. An extended rigid frame receiver sleeve as recited in claim 9, wherein:

the head assembly upper interface channel has a cross section corresponding to an external cross section of the forward upper sleeve element bottom section; and the forward portion upper sleeve element terminates in the head assembly upper interface channel.

11. An extended rigid frame receiver sleeve as recited in claim 10, wherein the weaver type interface return element is comprised of:

a top section having a generally rectangular shaped ross section, a flat top, flat base, two longitudinal sides and a longitudinal channel horizontally positioned along the length of each said longitudinal side;

a top section angled engagement surface extending from each edge of the base the full length of the top section and extending inwardly and downwardly; and a bottom section having a top portion, two long sides and a flat bottom, each of the two long sides having external angled engagement surfaces which extend the full length of the bottom section, wherein the surfaces each have a middle longitudinal section, upper longitudinal section, and lower longitudinal section, said upper section surface planes being directed outwardly and downwardly at a forty-five degree angle from the top section angled engagement surfaces, said middle section surface planes being directed vertically downwardly from said upper section surface planes in planes perpendicular to the horizontal plane of the flat bottom, and said lower section surface planes being directed inwardly and downwardly at a forty-five degree angle from the vertical planes of the middle sections to the flat bottom.

12. An extended rigid frame receiver sleeve as recited in claim 11, wherein:

said head assembly lower interface channel has a T-shaped cross section corresponding to the cross section of the weaver type interface return element top section.

13. An extended rigid frame receiver sleeve as recited in claim 12, wherein:

the weaver type interface return element top section engages the head assembly lower interface channel.

14. An extended rigid frame receiver sleeve as recited in claim 13, wherein:

said yoke has a generally rectangular shape with a rear face, forward face, central opening, upper interface channel, lower interface channel, and a longitudinal axis vertically positioned transverse to the horizontal longitudinal axis of the firearm.

15. An extended rigid frame receiver sleeve as recited in claim 14, wherein:

the yoke upper interface channel has a cross section corresponding in shape to the cross section of the forward portion upper sleeve element bottom section; and the junction between the forward upper sleeve element and the rearward portion receiver interface sleeve element is positioned within said yoke upper interface channel.

16. An extended rigid frame receiver sleeve as recited in claim 15, wherein:

the yoke assembly lower interface channel has a T-shaped cross section corresponding in shape to the cross section of the weaver type interface return element top section; and the weaver type interface return element top section terminates in the yoke assembly lower interface channel.

17. An extended rigid frame receiver sleeve as recited in claim 16, further comprising:

two hand guards mounted onto the forward interface portion interface, said hand guards being attached to the yoke and head assembly and adapted to rotate radially upward away from the weaver type interface return element, each said hand guard having a forward and a rear end terminating in a hinge, each said forward hinge being rotatably pinned to the rear face of the head assembly and each said rear hinge being rotatably pinned to the forward face of the yoke.

18. An extended rigid frame receiver sleeve as recited in claim 17, wherein:

the forward upper sleeve element has a front face; and an electrical output cavity formed in said front face.

19. An extended rigid frame receiver sleeve as recited in claim 18, further comprising:

a battery compartment located on one side of the head assembly.

20. An extended rigid frame receiver sleeve as recited in claim 19, further comprising:

a cavity activation switch mounted on the head assembly side.

21. An extended rigid frame receiver sleeve as recited in claim 20, further comprising:

A front sight mounted on the forward portion upper sleeve element top section at the head assembly.

22. An extended rigid frame receiver sleeve as recited in claim 21, further comprising:

a plurality of zeroing screws attached through said head assembly to said firearm barrel.

23. An extended rigid frame receiver sleeve as recited in claim 22, wherein said plurality of zeroing screws are comprised of:

four screws, two providing horizontal adjustment and one providing bottom vertical adjustment and one providing top vertical adjustment, said horizontal screws penetrating the sides of the head assembly and radially abutting said barrel, said bottom vertical screw penetrating the weaver interface, through the head assembly lower interface channel and radially abutting against said barrel, and said top vertical screw penetrating the forward portion upper sleeve element attached to the head assembly upper interface channel, through the head assembly upper interface channel and radially abutting said barrel.

24. An extended rigid frame receiver sleeve as recited in claim 23, further comprising:

a rear sight aperture positioned at the rear of sight plane formed by the longitudinal channel of the top section of the forward upper sleeve element of the forward interface portion and the longitudinal channel of the top section of the slidable sleeve element of the rearward interface portion.

* * * * *